United States Patent [19]

Lamont

[11] Patent Number: 4,553,385

[45] Date of Patent: Nov. 19, 1985

[54] INTERNAL COMBUSTION ENGINE

[76] Inventor: John S. Lamont, 3-333 Broadway, Winnipeg, Man., Canada, R3C 0T1

[21] Appl. No.: 553,083

[22] Filed: Nov. 18, 1983

[51] Int. Cl.[4] ..... F02G 3/02

[52] U.S. Cl. ..... 60/39.6; 123/190 BD

[58] Field of Search ..... 60/39.6, 39.63; 123/234, 236, 237, 238, 190 BD, 190 A; 137/625.21; 251/304

[56] References Cited

U.S. PATENT DOCUMENTS 1,062,999 5/1913 Webb ..... 60/39.6

FOREIGN PATENT DOCUMENTS 678108 3/1930 France ..... 60/39.6
779407 4/1935 France ..... 123/190 BD
4639882 9/1968 Japan ..... 60/39.63
198493 6/1938 Switzerland ..... 123/190 BD

*Primary Examiner*—Michael Koczo
*Assistant Examiner*—John J. McGlew, Jr.
*Attorney, Agent, or Firm*—Burns, Doane Swecker & Mathis

[57] ABSTRACT

An internal combustion engine has separate compression and expansion cylinders which are closed by a rotary valve structure. The rotary valve structure controls intake to the compression cylinder, transfer of compressed gas from the compression cylinder to a combustion chamber, transfer of combustion products from the combustion chamber to the expansion cylinder and exhaust of gases from the expansion cylinder. The valve structure is a one-piece rotationally symmetric unit which is synchronized with movement of piston assemblies carried in the compression cylinder and expansion cylinder, respectively. To maximize compression, the piston face is shaped to conform with rotationally symmetric sides of the valve structure. And to expand the combustion products to near ambient pressure, the expansion cylinder and cooperating piston assembly have a larger volume than the compression cylinder and cooperating compression piston assembly.

15 Claims, 9 Drawing Figures

Fig. 2
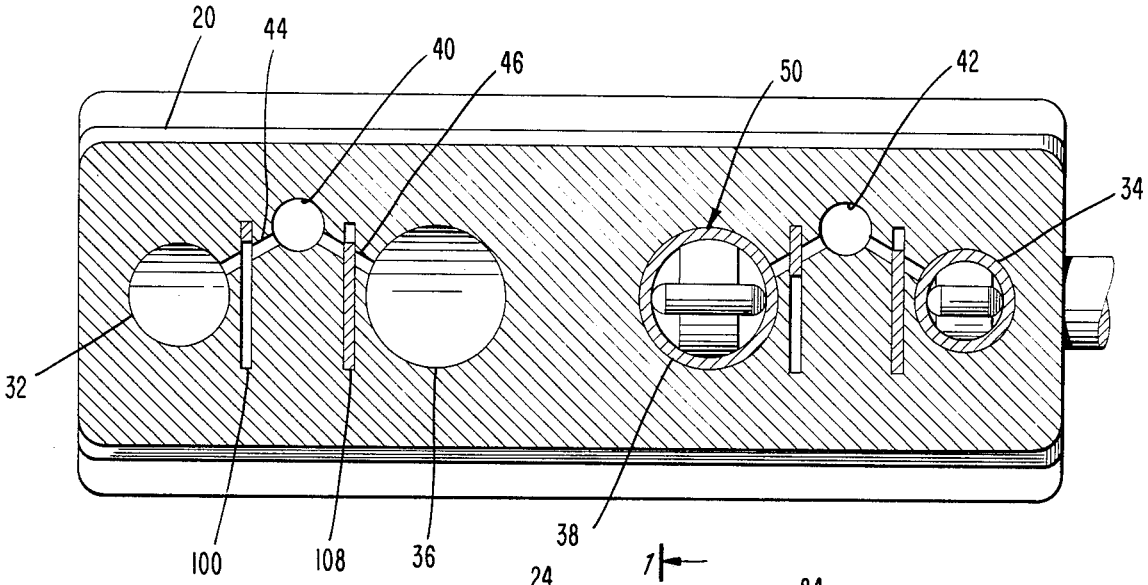
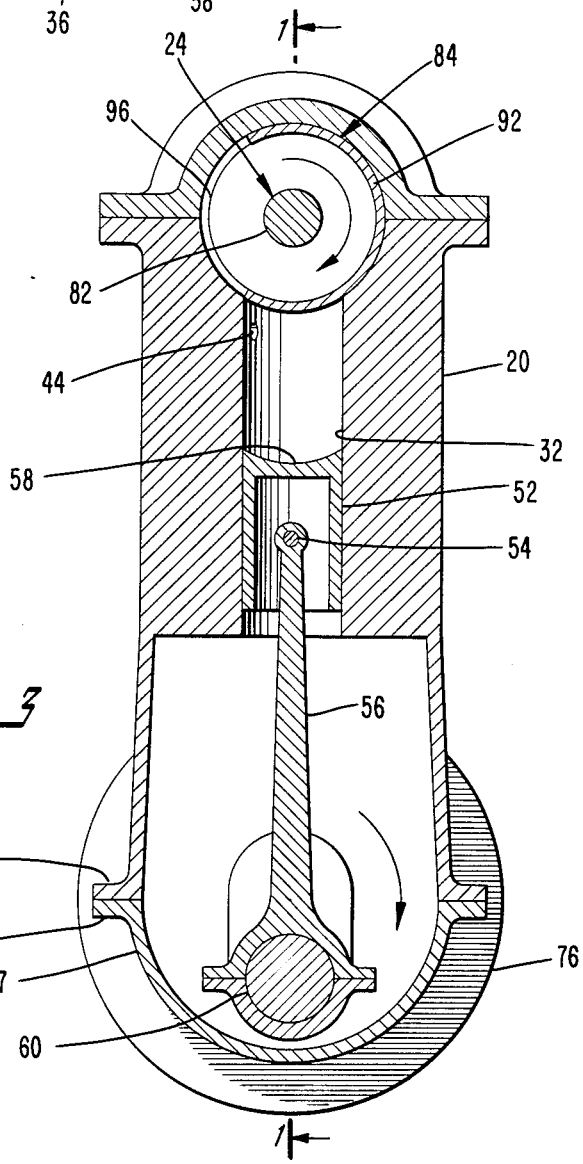
Fig. 3

Fig. 4
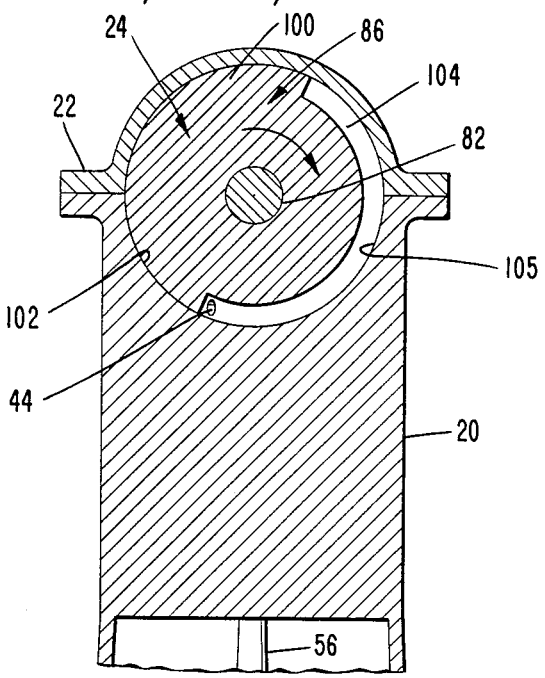
Fig. 5
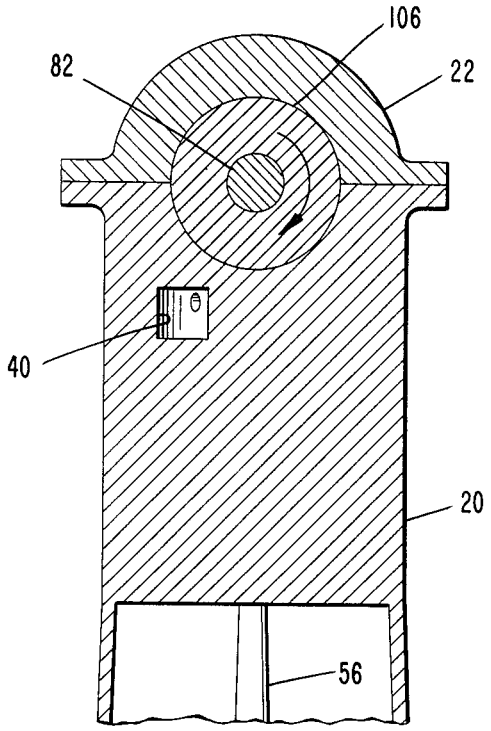
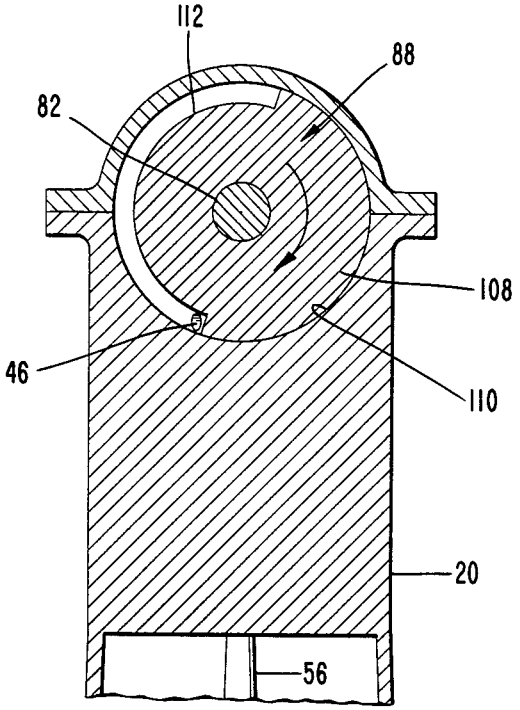
Fig. 6
Fig. 7
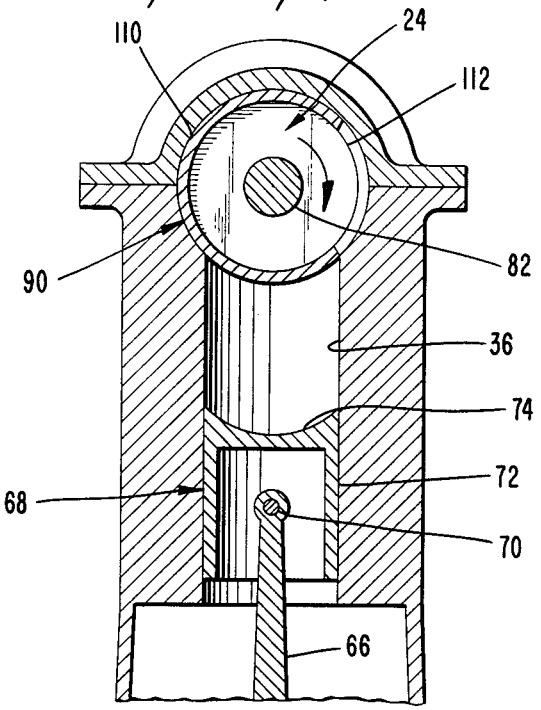

INTERNAL COMBUSTION ENGINE

BACKGROUND OF THE INVENTION

The present invention relates generally to internal combustion engines. More particularly, the present invention concerns internal combustions of the type using a transfer chamber to separate the intake and compression functions from the exhaust and expansion functions.

It has long been known that internal combustion engines generate useful power from a charge of fuel mixed with atmospheric air. Typically, the engine ingests a charge of a fuel-air mixture engine, compresses it to a small fraction of its original volume, ignites the compressed charge with, for example, a spark, allows the combustion products to expand against a piston, and finally exhausts the combustion products. Ordinarily, all of the foregoing steps occur in a single piston cylinder arrangement.

Where a single piston cylinder arrangement is employed, the expansion of the combustion products which occurs during the expansion phase of operation, does not reduce the pressure of the combustion products to ambient pressure, or for that matter, a pressure close to ambient. As a result of this characteristic, energy in the form of elevated pressure and elevated temperature is not recovered prior to rejection of exhaust products to the atmosphere. By failing to harness the available energy, the thermodynamic cycle efficiency of such internal combustion engines is, naturally, lower than it might otherwise be.

When the relatively high pressure combustion products are exhausted to the atmosphere, pressure pulses occur which are the source of acoustic noise. This acoustic noise usually requires a muffler in the exhaust system in order to be environmentally acceptable. However, the presence of a muffler in the exhaust system creates a back-pressure on the internal combustion engine cycle which contributes even further to diminished thermodynamic cycle efficiency.

In the past, various techniques have been considered to overcome the deficiencies of the conventional internal combustion engine cycle described above. In one such device, a piston cylinder assembly has been provided which has an annular expansion-exhaust chamber surrounding a central cylindrical intake-compression chamber with a piston arrangement that reciprocates in both chambers simultaneously. See, U.S. Pat. No. 4,096,835 issued June 27, 1978 to Charles E. Lamont. This device uses a valving arrangement to control the transfer of compressed gases from the central chamber to the annular chamber disposed circumferentially with respect thereto. Difficulty in aspirating the central cylindrical intake-compression chamber coupled with substantial heat loss associated with the very high surface to volume ratio in the combustion chamber lead to practical problems in this device.

Other devices have also been proposed in which the compression and expansion functions are separated. To effect this separation, a rotating valve assembly having an internal transfer chamber has been employed. See, for example, U.S. Pat. No. 3,555,814 issued Jan. 19, 1971 to Morsell, III. Such devices are, however, not satisfactory since the combustion chamber is contained in the rod itself. With the combustion chamber in the rod, the hot, high pressure combustion products cause extremely high thermal stresses in the valve rod and result in a risk of explosion. In an analogous device, sliding valves are provided in a conduit which valves effect the transfer of the gaseous charge from a separate compression cylinder to a distinct expansion cylinder. See, for example, U.S. Pat. No. 611,125 issued Sept. 20, 1898 to Humphrey.

Another device, attributed to Kristiansen, sought to provide increased expansion when compared to the compression ratio by using a cylinder type engine in which the cylinders rotated about a drum cam. The cam provided considerably increased expansion on the expansion portion of the cycle in comparison to the compression attained in the compression portion thereof. The Kristiansen engine, however, does not have the features making it susceptible to commercialization.

From the foregoing discussion, it will be apparent that the need continues to exist for an internal combustion engine which overcomes problems of the type discussed above while permitting an increased thermodynamic cycle efficiency to be obtained. The increased cycle efficiency is highly desirable in light of the expense of obtaining petroleum and the increased emphasis on efficient utilization of that natural resource.

SUMMARY OF THE INVENTION

The present invention provides a separate compression cylinder and expansion cylinder within an engine block. The cylinders are closed by a rotationally symmetric valve arrangement disposed at one end of the respective cylinders. Corresponding reciprocating piston assemblies are provided for each cylinder, with rotational movement of the valve structure and reciprocating movement of the piston assemblies being synchronized. In addition, a combustion chamber is provided to receive and ignite the compressed fuel-air mixture prior to its expansion in the expansion cylinder. The valve assembly controls intake and exhaust as well as communication between the compression cylinder, the expansion cylinder and the combustion chamber.

To permit essentially all of the gas compressed in the compression cylinder to be expelled into the combustion chamber and to obtain an efficient compression ratio, the top face of the compression piston assembly is shaped to conform to the rotationally symmetric inlet valve at the end of the compression cylinder.

In order to harness the maximum amount of energy in the expansion portion of the cycle, the surface of the expansion piston assembly is likewise shaped to conform to the rotationally symmetric surface of the exhaust valve. Moreover, the maximum volume of the expansion cylinder is substantially larger than the volume of the compression cylinder. In this fashion, a minimal volume is presented to the combustion products when the expansion piston is most closely adjacent to the exhaust valve assembly and expansion of the exhaust products prior to extracting useful work from those products is minimized. Furthermore, because of the greater volume in the expansion cylinder, the combustion products are expanded to a much lower pressure and temperature so that less available energy is wasted.

By placing the rotary valve structure at one end of the compression cylinder and expansion cylinder, the inlet and exhaust ports can be shaped as desired and can even be enlarged to provide ports having virtually 100% of the cylinder cross-sectional area for ingestion and exhaust of gases. This feature greatly facilitates the ease and speed of ingestion and exhaust of the gases over existing types of internal combustion engines using the same chamber for compression and expansion since such engines must use an area much less than 50% of the cylinder cross-sectional area. In existing engines that restriction reduces the flow rates of gases. The absence of such a restriction in this invention contributes to an increased power output through improved volumetric efficiency.

Preferably, the valve structure is mounted on a shaft and is provided with circularly cylindrical surfaces. With such an arrangement, all valving functions are precisely timed relative to one another within the valve, because timing is built into the shape of the circular valve structive itself. Moreover, there is no degradation in valve timing relationships with time as engine parts wear.

BRIEF DESCRIPTION OF THE DRAWINGS

Many objects and advantages of the present invention will be apparent to those skilled in the art when this specification is read in conjunction with the attached drawings wherein like reference numerals are applied to like elements and wherein:

FIG. 2 is a partial cross-sectional view taken along the line 2—2 of FIG. 1;

FIG. 3 is a partial cross-sectional view taken along the line 3—3 of FIG. 1 illustrating the inlet valve;

FIG. 4 is a partial cross-sectional view taken along the line 4—4 of FIG. 1 illustrating the first transfer valve;

FIG. 5 is a partial cross-sectional view taken along the line 5—5 of FIG. 1 showing relative placement of the transfer chamber;

FIG. 6 is a partial cross-sectional view taken along the line 6—6 of FIG. 1 illustrating the second transfer valve;

FIG. 7 is a partial cross-sectional view taken along the line 7—7 of FIG. 1 illustrating the exhaust valve;

DESCRIPTION OF THE PREFERRED EMBODIMENT

Figure 1:
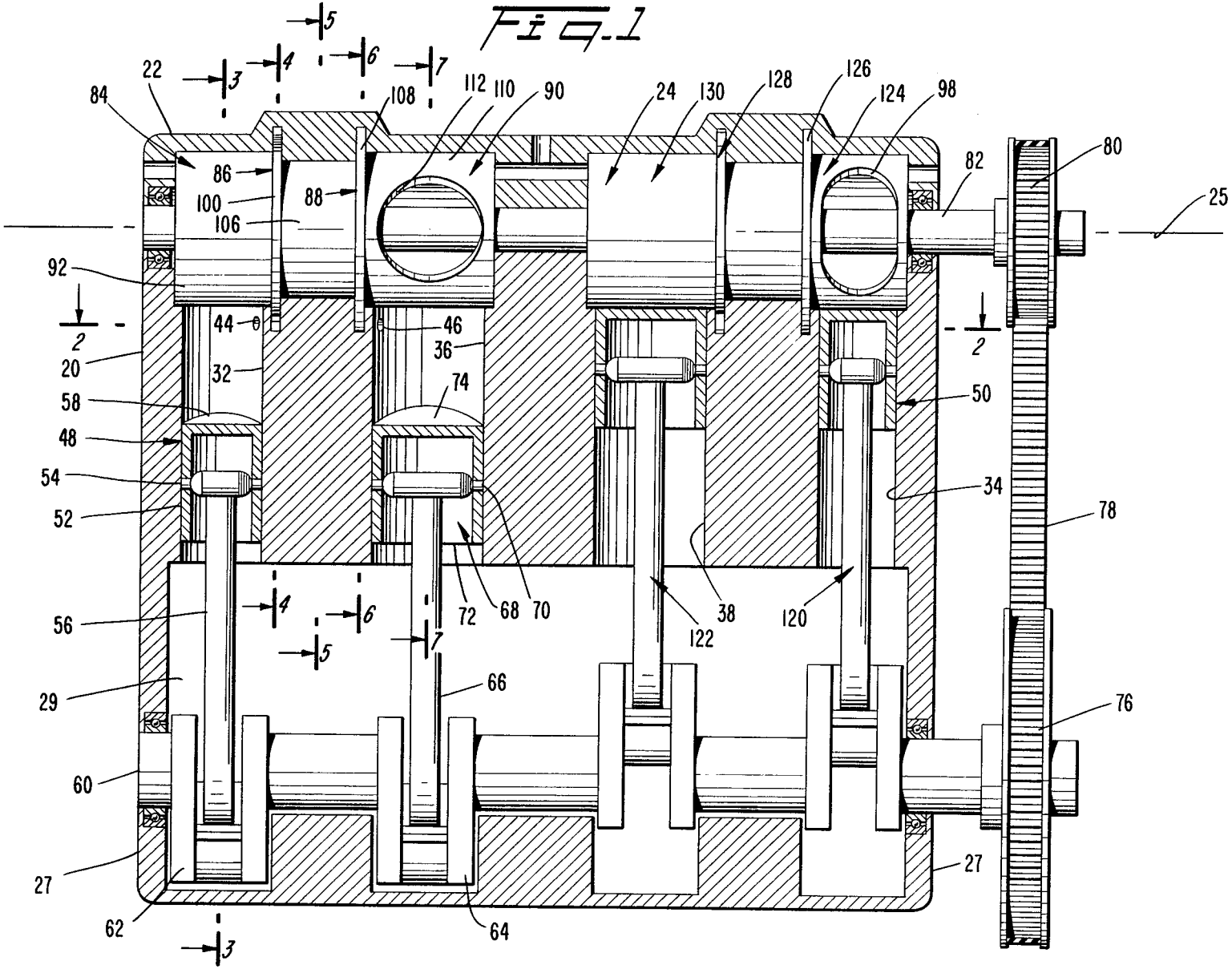
FIG. 1 is a partial cross-sectional view taken along the line 1—1 of FIG. 3.

In accordance with the present invention, an internal combustion engine (see FIG. 1) includes an engine block 20 which is fashioned from a suitable conventional material in a known manner. At one end of the block 20, a valve cover 22 is provided which encloses a rotary valve means 24. The valve cover 22 is suitably attached to the engine block 20 by threaded fasteners and pressure seals and holds the valve assembly 24 in pressure-tight engagement with the upper end of the engine block 20. Seals (not shown) consisting of suitable conventional rotating peripheral ring seals around either side of each of the inlet and outlet portions of the rotating valve, plate seals around the disk valves, and face seals blocking passage of gases from the cylinders to the inlet and exhaust ports when the ports are closed, the latter plate and face seals based on existing technology, and all of which are pressure activiated, may be provided on the valve means 24, the engine block and the associated cylinders to effect the requisite pressure seals. Since the rotary valve means 24 is rotationally symmetric, the adjacent end of the engine block 20 has a surface portion shaped to conform to the side surface of the rotary valve means 24. Moreover, to facilitate assembly and disassembly, the engine block 20 and the valve cover 22 are preferably arranged to be connected in a plane passing through the rotational axis 25 of the rotary valve means 24.

Connected to a second end of the block 20 is a crankcase. The crankcase is located on the engine block 20 on a side surface opposite to the valve cover 22 and includes a lower housing 27. This housing 27 is fashioned from suitable conventional material such as cast iron. The lower housing 27 is attached to the engine block 20 by suitable conventional fasteners and oil seals along appropriate flanges 28, 30 (see FIG. 3) which may be provided on the block 20 and lower housing 27, respectively, for this purpose. Together, the engine block 20 and the lower housing 27 (see FIG. 1) define a chamber 29 in which the crank shaft operates.

The block 20 is provided with a pair of compression cylinders 32, 34 and with a pair of expansion cylinders 36, 38. The axes of the compression cylinders 32, 34 and the axes of the expansion cylinders 36, 38 are preferably parallel to one another and also coplanar. Moreover, the expansion cylinders 36, 38 are disposed between the compression cylinders 32, 34. With this spatial juxtapositioning of the expansion cylinders, exhaust products from both expansion cylinders 36, 38 can be conveniently combined for release to the ambient atmosphere. It is of course clear that the relative position of the compression and expansion cylinders may be reversed, if desired.

The cylinders are arranged in cooperating units: the first unit including a compression cylinder 32 and an adjacent expansion cylinder 36; the second unit including a compression cylinder 34 and an adjacent expansion cylinder 38. Disposed between the cylinders 32, 36 and 34, 38 of each cooperating unit is a corresponding combustion chamber 40, 42 (see FIG. 2). Each combustion chamber 40, 42 communicates with the associated compression cylinder 32, 34 and the associated expansion cylinder 36, 38 by a fluid communication means that includes a first channel 44 and a second channel 46.

The first channel 44 extends between the compression cylinder 32 and the combustion chamber 40 and is operable to permit fluid communication therebetween. In analogous fashion, the second channel 46 extends between and provides fluid communication between the expansion cylinder 36 and the combustion chamber 40. These transfer channels 44, 46 are sized to provide substantially unrestricted flow of compressed gases from the compression cylinder 32 to the combustion chamber 40 and to provide similar passage of combustion products from the combustion chamber 40 to the expansion cylinder 36.

A piston assembly is provided for each of the cylinders in the block 20 (see FIG. 1). Preferably, the cylinders 32, 34, 36, 38 are circularly cylindrical so that cooperating piston assemblies may also be circularly symmetric. More particularly, a compression piston means 48, 50 is provided in each of the compression cylinders 32, 34.

The compression piston means 48 includes a piston body 52 which is generally circular in cross-section (see FIG. 2) and mounted to be axially reciprocable within the corresponding compression cylinder 32. The compression piston means 48 is moveable between the first position (as illustrated in FIG. 1) and a second position closely adjacent the rotary valve means 24. Spatial relationships between the piston means 48, the rotary valve means 24 and the engine block 20 at this second position are essentially illustrated by the similar compression piston means 50 in FIG. 1.

The upper surface or face 58 of the compression piston means is shaped to conform to the rotationally symmetric surface portion of the rotary valve means 24 closing the opposing end of the compression cylinder 32 (See FIG. 3). In this manner, the face 58 can move into very close spatial relation to the valve means 24 thereby expelling compressed gases to the combustion chamber 40 (see FIG. 2) almost completely.

In addition, the compression piston means 48 includes a connecting rod 56 and a connecting pin 54 which attaches the piston body 52 to a connecting rod 56 so that the connecting rod 56 can move in an arc as the piston head 52 reciprocates in the compression cylinder 32. The connecting rod 56 attaches the piston 52 to a crankshaft 60 located in the crank chamber 29. The crankshaft is rotatably mounted in the crankcase assembly 27 in a conventional manner and provides the source of power to translate the compression piston means 52 within the compression cylinder 32. A journal bearing at one throw 62 (see FIG. 1) of the crankshaft 60 permits attachment of the connecting rod 56. At an adjacent throw 64 of the crankshaft 60, a second connecting rod 66 is also rotatably connected with a journal bearing. This second connecting rod 66 is part of an expansion piston means or assembly 68 that is slidably and reciprocably mounted within the expansion cylinder 36. The second connecting rod 66 is journalled at one end to the second throw 64 of the crankshaft 60 and is journalled at the opposite end to a connecting pin 70 which is carried by an expansion piston body 72.

As with the compression piston body 52, the expansion piston body 72 is circularly symmetrical, cylindrical, and is adapted to slide axially within the corresponding expansion cylinder 36. The upper surface or face 74 of the piston body 72 is generally circularly arcuate in cross-section (see FIG. 7) and designed to conform to the rotationally symmetric surface portion of the rotary valve means 24 which closes the end of the expansion cylinder 36. As with the compression piston means 58, the cylindrical surface 74 permits the expansion piston 72 to move into very close proximity to the rotary valve means 24. In this fashion, the volume into which combustion products can expand without doing useful work is minimized.

A compression chamber is defined by the rotary valve means 24, the compression piston means 48 and the corresponding compression cylinder 32. Similarly, an expansion chamber is defined by the rotary valve means 24, the expansion piston means 72, and the corresponding expansion cylinder 74. The compression chamber is sealed from the crankshaft chamber by suitable conventional ring seals (not shown) carried by the compression piston means 48. Such ring seals are positioned so that the compression chamber always has fluid communication with the transfer passage 44. The expansion chamber is similarly sealed from the crankshaft chamber with correspondingly positioned ring seals.

The throws 62, 64 of the crankshaft 60 may be in angular alignment with one another relative to the axis of the shaft 60. However, if desired, a phased relationship between the two throws may be provided by fabricating the crankshaft with a predetermined angle between the first and second throws 62, 64.

One end of the crankshaft 60 projects from the crankcase assembly 26, 27 and is provided with a suitable conventional timing gear 76. The timing gear 76 cooperates with a timing chain 78 and a second or driven timing gear 80 carried by a shaft 82 of the rotary valve means 24. Preferably, the timing gear 76 and the second timing gear 80 have identical external diameters and numbers of teeth so that each revolution of the crankshaft 60 corresponds to one revolution of the shaft 82 and rotary valve means 24. The crankshaft 60, the timing gears 76, 80 and the timing chain 78 together provide a means for synchronizing the rotational movement of the rotary valve means 24 with the reciprocating motion of the compression piston means 48 and the expansion piston means 68.

The timing chain 78 and the timing gears 76, 80 may be of any suitable conventional construction which does not permit relative slippage between the timing chain 78 and the associated driving and driven members such as gears 76, 80. For example, chain and sprocket devices or flexible belts having transverse ribs received by conforming grooves in the driving and driven timing members may also be used.

Turning now to the rotary valve means 24, the rotary valve means itself is preferably fashioned as an integral one-piece unit which provides all valving functions for the engine. More particularly, the rotary valve means 24 provides control of fluid communication between the compression cylinder 32 and an inlet containing a gas, such as air, or a fuel-air mixture. This portion of the rotary valve assembly 24 will be referred to as the inlet valve 84. The rotary valve means 24 also includes a first transfer valve 86 and a second transfer valve 88. The first transfer valve 86 controls communication through the first transfer channel 44 (see FIG. 2) while the second transfer channel 88 controls fluid communication through the second transfer channel 46. Finally, the rotary valve means 24 includes an exhaust valve 90 (see FIG. 1) which controls discharge or exhaust of combustion products from the expansion cylinder 36.

The inlet valve 84 includes a rotationally symmetric sleeve 92 that is attached to and mounted for rotation with the shaft 82. Preferably, the sleeve 92 is circularly cylindrical, as shown (see FIG. 3). The inlet valve 84 has an inlet port 96 which moves into and out of communication with the compression cylinder 32 as the rotary valve assembly 24 rotates (see FIG. 3).

The inlet port 96 establishes a lateral opening through the sleeve 92 and may be configured as desired in order to provide the desired schedule of opening and closing communication between the inlet and the compression cylinder 32. One suitable configuration is shown in FIG. 1 at 98. This inlet configuration provides a port which opens to expose essentially 100% of the compression cylinder 34 so as to minimize restriction to the flow of air into the compression cylinder 34. The angular extent of the inlet port 96 determines the period of time during each revolution of the rotary valve 24 that the inlet valve is open. As illustrated, the inlet valve 84 is attached to the shaft 82 by means of a disc 100 which is part of the first transfer valve 86.

The first transfer valve 86 (see FIG. 1) includes the disc 100 having a periphery 102 (see FIG. 4). A radially undercut land 104 of the periphery 102 provides sufficient radial clearance between the disc 100 and the surrounding groove 105 to expose the first transfer channel 44. The outer radius of the disc 100 is selected such that a portion of the disc 100 is operable to cover the first transfer channel 44. Accordingly, the angular extent of the undercut land 104 defines the period of time in each revolution of the shaft 82 during which the first transfer valve 86 allows fluid communication through the first transfer channel 44.

Positioned between the first transfer valve 86 and the second transfer valve 88 (see FIG. 1) is a second disc 106 which has a diameter substantially less than the first disc 100. The disc 106 (see FIG. 5) is in general alignment with the combustion chamber 40 and is part of the sealing arrangement for the first and second transfer valves 86, 88.

With respect to seals, it will be noted that for convenience and clarity of the concept that various seals between the rotary valve means 24 and the cooperating structure are not illustrated. However, seals are of course provided at the interface between the rotary valve means 24 and the opening to the compression cylinder 32 and the opening to the expansion cylinder 36. In addition, seals must be provided on both sides of each disc valve 100, 108 to seal the interfaces between each disc 100, 108 and the corresponding transfer channel 44, 46.

The second transfer valve 88 (see FIG. 6) also includes the disc 108 having a periphery 110 which is undercut radially to the land 112. The distance of the radial undercut is sufficient to completely uncover the second transfer channel 46. Moreover, the outer diameter of the disc 108 is selected so as to cover the second transfer channel during a portion of rotation of the second transfer valve 88. The arcuate extent of the undercut 112 defines the length of time during each revolution of the valve means 24 that the second transfer valve allows flow through the second transfer channel 46.

The exhaust valve means 90 (see FIG. 1) is also fashioned from a rotationally symmetric sleeve 110 which is supported by the disc 108 of the second transfer valve. The sleeve 110 is provided with a lateral exhaust port 112 (see FIG. 7). The exhaust port 112 has an angular length selected to open the exhaust port to provide fluid communication with the expansion cylinder 36 through the portion of exhaust valve 90 rotation during which exhaust products are being expelled from the engine 20. As with the inlet valve port, the exhaust port 112 (see FIG. 1) may be shaped as desired to provide the flow characteristics for exhaust products leaving the expansion cylinder 36. And in particular, the exhaust port 112 can be designed to expose practically 100% of the expansion cylinder 36. The annular area between the shaft 82 and the cylindrical valve sleeves 92, 110 is substantially unrestricted. With such an arrangement, the intake and exhaust of air and combustion products, respectively, is substantially unimpeded.

Figure 8:
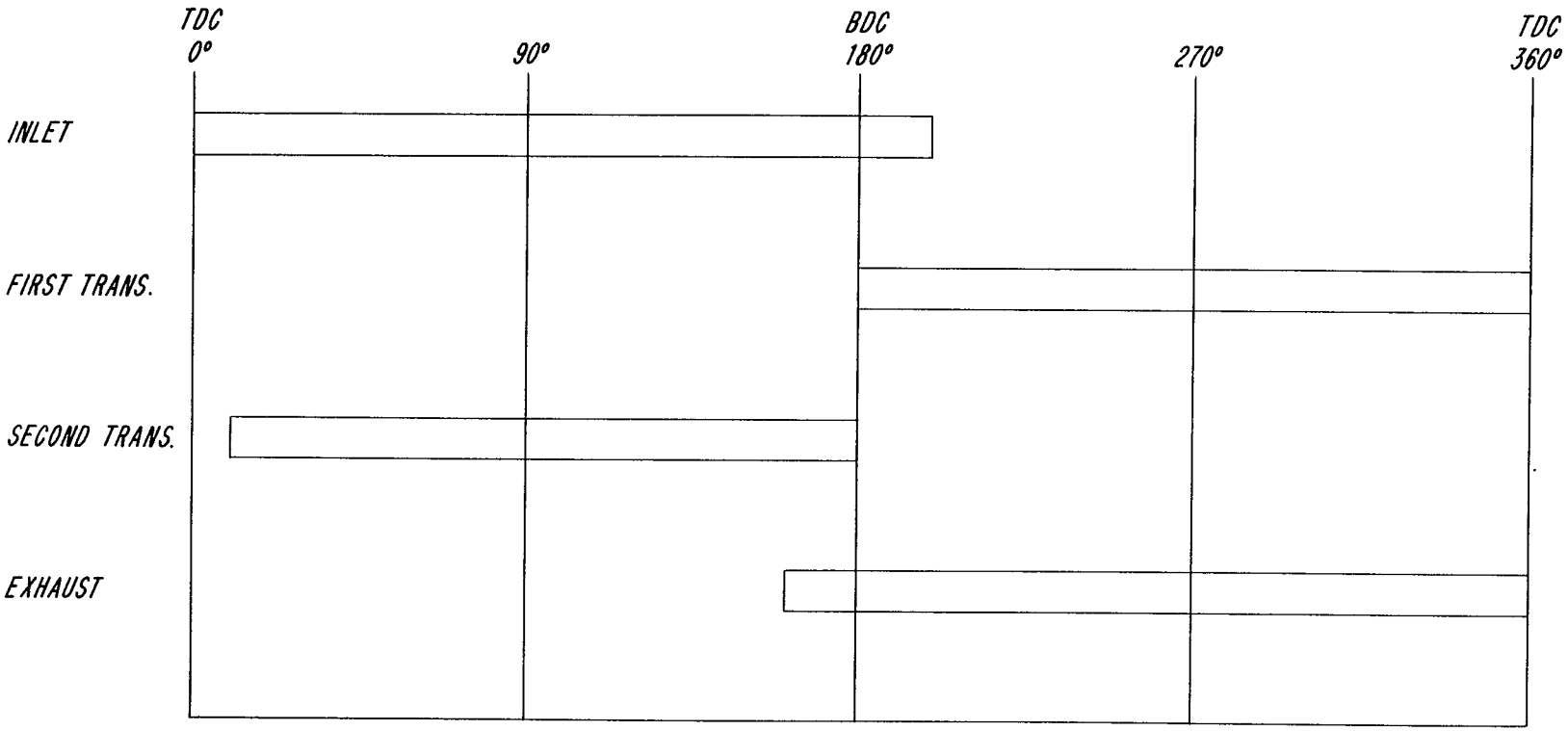
FIG. 8 is a schedule showing the valve sequencing in the present invention.

If desired, the discs 100, 106, 108 (FIG. 1) may be integral and may be machined from a single piece of material. Moreover, the sleeves 92, 110 may also be integral with and machined from that single piece of material, if desired. The integral construction of the rotary valve means 24 makes it possible to properly and precisely time the operation of the inlet valve 84, the first transfer valve 86, the second transfer valve 88, and the exhaust valve 90 by their angular relationships. While many valve sequencings are possible for an internal combustion engine such as that described above, a suitable valve sequencing pattern is illustrated in FIG. 8. Clearly, in the following illustrative sequencing pattern it is possible that valve positions may vary by several degrees. For example, the inlet valve 84 opens at, or after, top dead center ("TDC") and remains open until at least 5° after bottom dead center ("BDC"). During this time, the compression cylinder 32 receives a charge of an air-fuel mixture. The second transfer valve 88 opens at least 5° after top dead center, preferably no later than the point of peak pressure in the combustion chamber, and remains open until bottom dead center. During this time interval, the expansion cylinder 36 receives combustion products from the combustion chamber 40 which expand and drive the expansion piston means 68.

The first transfer valve 86 opens at bottom dead center and remains open until top dead center so that the compression piston means 48 can compress the fuel-air mixture into the combustion chamber 40. The exhaust valve 90 also opens slightly before bottom dead center and remains open until top dead center so that spent combustion products can be discharged. Moreover, during the period of time from top dead center until 5° after top dead center, all valves to the combustion chamber 40 are closed so that a substantially constant volume combustion occurs in the combustion chamber.

The compression piston 52, the compression cylinder 32 and the inlet valve 88 define a first volume. Similarly, the expansion piston 72, the expansion cylinder 36 and the outlet valve 90 define a second volume. The second volume is designed to be substantially larger than the first volume. Preferably, the ratio of the second volume to the first volume lies in the range of 1.5 to 3, and preferably is about 2. Ordinarily, the second volume is selected so as to expand combustion products to a pressure which is equivalent to ambient pressure or just slightly thereabove. In this fashion, the expansion piston means 68 extracts the most amount of work possible from the exhaust products. Moreover, the need for mufflers can be eliminated due to the absence of pressure pulses being released into the ambient atmosphere.

The combustion chamber 40 (see FIG. 2) is sized to have a volume in the range of one-sixth to one-twelfth the volume of the compression chamber. Preferably, the combustion chamber 40 has a volume of approximately one-eighth of the compression chamber or first volume. In this fashion, the compression ratio for the compression portion of the cycle is approximately 8:1. This preferred compression ratio and the related volume ratio of the compression chamber and the combustion chamber apply to the classical Otto cycle operation. If a diesel cycle is employed the compression ratio is significantly higher.

Within the second compression cylinder 34, a compression piston means 120 is provided, and, within the expansion cylinder 38, a corresponding expansion piston assembly 122 is provided. The rotary valve means 24 includes an inlet valve 124, a first transfer valve 126, a second transfer valve 128 and an exhaust valve 130 to control the intake, transfer and exhaust of gaseous products among the compression cylinder, expansion cylinder and combustion chamber. The compression piston assembly 120 is in all respects identical to the compression piston assembly 48. Moreover, the expansion piston assembly 122 is in all respects identical to the expansion piston assembly 68. Likewise, the rotary valves 124, 126, 128, 130 are similar in all respects to the corresponding valves 84, 86, 88, 90. Accordingly, it is not necessary to repeat the detailed description as to these features.

The only difference between the second pair of cylinders 34, 38 and the first pair of cylinders 32, 36 and their respective assemblies is that the pistons and valves of the second pair of cylinders 34, 38 are 180° out of phase with the corresponding structures of cylinders 32, 36. This phased relationship is accomplished by the angular relationship of the crankshaft throws for the compression piston means 120 and for the expansion piston means 122 relative to the corresponding throws 62, 64 for the piston means 48, 68.

In this preferred embodiment, a two cycle Otto cycle engine has been discussed. However, it will be apparent to those skilled in the art that the teachings and principles of this invention can also be applied to diesel cycle engines. Moreover, while the preferred embodiment has been discussed as ingesting a carburated fuel-air mixture, it is also within the purview of this invention to ingest air and inject fuel into the air during and after compression thereof. Furthermore, the combustion in the combustion chamber can be effected in any of several conventional manners including spark ignition and self-ignition, among others.

As shown in FIG. 1, the two sets of cylinders 32, 36 and 34, 38 are arranged in an in-line relationship. It will, however, be apparent to those skilled in the art that the cylinder sets might also be arranged in a side-by-side flat four arrangement or a V-four arrangement or others. Moreover, it is within the scope of this invention to provide even greater multiples of compression and expansion cylinder pairs.

OPERATION

At the beginning of an engine cycle, the crankshaft 60 turns causing a compression piston means, e.g., 120, to begin moving from top dead center toward bottom dead center. At about the same time, top dead center, the associated inlet port 98 in the associated inlet valve 124 (see FIG. 3) begins to overlap and uncover the opening at the upper end of the associated compression cylinder 34. Continued movement of the compression piston means 120 toward bottom dead center sucks in a charge of air or a carburetted charge of air-fuel mixture. Ingestion of this charge continues until the piston means 120 reaches bottom dead center since the port 98 has at least partial registry with the cylinder 34 throughout the period of the downward stroke of the compression piston means 120.

As the compression piston means, e.g, 48 begins its upward movement from bottom dead center toward top dead center, the associated first transfer valve 86 uncovers the associated first transfer channel 44 (see FIG. 4) and establishes fluid communication between the associated compression cylinder 32 (see FIG. 1) and the associated combustion chamber 40 (see FIG. 2). After the compression piston means 48 moves about 5° from bottom dead center (FIG. 3), the associated inlet port 96 is out of registry with the associated compression cylinder 32 and compression of the charge begins.

When the compression piston means 48 reaches top dead center, the radially enlarged portion of the disc 100 of the associated first transfer valve means 86 interrupts communication through the associated first transfer channel 44 (see FIG. 4). The compressed charge of fuel-air mixture in the combustion chamber is then ignited so that combustion takes place converting the mixture of air and fuel into combustion products having an elevated temperature and an elevated pressure. In the event that it is desired to eliminate carburetion and use fuel injection, a charge of fuel would be injected directly into the pressurized air in the combustion chamber and ignited.

As the compression piston means, e.g., 120 (see FIG. 1) begins its downward stroke from top dead center toward bottom dead center to ingest a fresh charge of air, the associated second transfer valve, e.g., 128 uncovers the associate second transfer channel 46 (see FIG. 6) and establishes fluid communication between the combustion chamber 40 (see FIG. 2) and the associated expansion cylinder, e.g., 38. As the combustion products enter the expansion cylinder 38, the elevated pressure drives the associated expansion piston means 122 downwardly imparting rotational energy to the crankshaft 60 in a conventional manner.

When the expansion piston means, e.g., 68 reaches bottom dead center (FIG. 1), the associated exhaust valve 90 has rotated such that its exhaust port 112 comes into at least partial registry with the expansion cylinder 36 so as to establish fluid communication between the expansion cylinder 36 and the exhaust system.

At bottom dead center, the associated second transfer valve 88 closes and interrupts fluid communication through the associated second transfer channel 46. The associated exhaust valve 90 remains open until the expansion piston means 68 reaches its top dead center position whereupon the exhaust valve 90 closes and interrupts fluid communication with the expansion cylinder 36.

During the period of time when the expansion piston means 68 is exhausting the spent products of combustion, the compression piston means 48 is compressing a fresh charge of air into the combustion chamber. Similarly, it will now be apparent that when the expansion piston means 68 is extracting energy from the combustion products, the compression piston assembly 48 is ingesting a fresh charge. As a result, there is a power stroke during half of each revolution of the crankshaft 60. This represents a considerable advantage when compared to conventional four stroke internal combustion engines since twice as many power strokes are provided in engines operating at the same rpm.

While the different capacities shown for the compression cylinder 32 and the expansion cylinder 36 can be obtained in this invention by changing the diameter of the cylinders while the stroke length remains constant, it should be clear that this volumetric difference can be effected also by enlarging the stroke of the expansion piston means 68 relative to the stroke of the compression piston means 48. Alternatively, a combination of diameter enlargement and stroke enlargement may also be considered to effect the desired volumetric differences. There may, of course, be advantages obtained by changing the stroke of the expansion piston relative to the stroke of the compression piston. For example, a longer moment arm would be available to apply torque to the crankshaft 60. Moreover, increased flywheel inertia from the longer throw required to accommodate a longer stroke on the expansion piston means 68 may be desirable.

When an internal combustion engine is operated in accordance with the invention as described above, a substantially improved thermodynamic cycle efficiency is obtained.

The cycle efficiency (e) for the air standard Otto cycle engine with hyper expansion can be calculated as follows:

$$e = \frac{\text{heat added} - \text{heat rejected}}{\text{heat added}} \quad \text{[Eq. A]}$$

$$= \frac{C_V(T_3 - T_2) - C_P(T_4' - T_1)}{C_V(T_3 - T_2)}$$

$$\theta = 1 - k\left[\frac{T_4' - T_1}{T_3 - T_2}\right]$$

where $K = C_P/C_V$; $C_V$ is the specific heat of gas at constant volume; $C_P$ is the specific heat of gas at constant pressure; $T_1$ is ambient gas temperature; $T_2$ is the gas temperature after compression; $T_3$ is the gas temperature after combustion; and $T_4'$ is the exhaust gas temperature at the end of the extended expansion.

The same analysis can be conducted for the air cycle diesel, with and without hyper-expansion, and the following expressions for cycle efficiency will result:

The conventional diesel cycle:

$$e = 1 - \frac{T_4 - T_1}{k(T_3 - T_2)}$$

The diesel cycle with hyper-expansion to atmospheric pressure:

$$e = 1 - \frac{T_4' - T_1}{T_3 - T_2}$$

To assist in the analysis of the present engine, the air cycle efficiency can be expressed by writing equation A in more usable form as follows:

$$e = 1 - \frac{k[(E/C) - 1]}{C^{k-1}[(E/C)^k - 1]} \quad \text{[Eq. B]}$$

where $k = C_P/C_V$; $C = V_1/V_2$ = compression ratio; $E = V_4'/V_3$ = expansion ratio; $V_1$ is the volume of the compression chamber before compression; $V_2$ is the volume of the compression chamber after compression; $V_4'$ is the volume of the expansion chamber after expansion; $V_3$ is the volume of the expansion chamber before expansion.

The foregoing equation is for the complete expansion cycle, and is not indicative of the process likely to be found in a real hyper-expansion engine. More likely is an engine which expands chamber gas to a pressure somewhat above atmospheric pressure because the expansion ratio is limited by practical operating constraints. It can be shown that the cycle efficiency for such an engine is given by:

$$e = 1 \frac{t(E/C)^{1-k} + (E/C)(k - 1) - k}{C^{k-1}(t - 1)} \quad \text{[Eq. C]}$$

where $t = T_3/T_2$; and the other terms are the same as defined above.

To maintain cylinder pressure at the end of expansion above atmospheric pressure, $t \geqq (E/C)^k$.

When $t = (E/C)^k$ complete expansion occurs and equation B is reduced to equation B.

Figure 9:
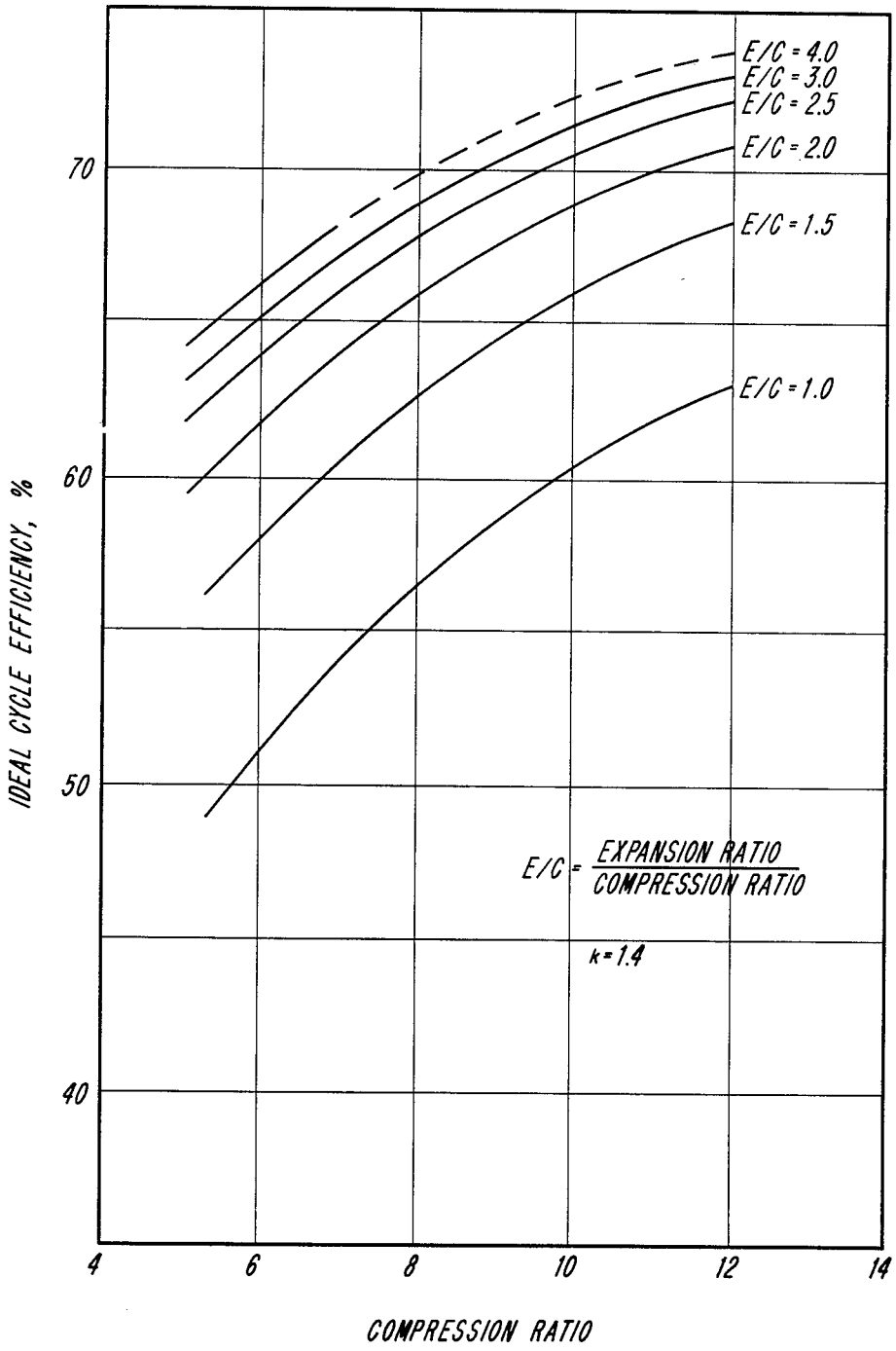
FIG. 9 is a chart of ideal cycle efficiency as a function of compression and expansion ratios.

It should be noted that $T_2$ is a function of the compression ratio used and the inital temperature $T_1$. $T_3$ is a function of the constant volume heat addition-usually 1,260 BTU/LBM of air for this type of analysis. The improved ideal cycle efficiencies attainable with this invention are graphically illustrated in FIG. 9. Numerous other advantages are also available with this invention. For example, all valving operations are synchronized relative to one another by the spatial relationship of parts. In addition, a single rotating piece provides all the valving operations without the mechanical complexity of rocker arms, springs, poppet valves and the like.

The engine of this invention provides increased fuel efficiency since more energy is extracted from the combustion products prior to exhaust. Because the exhaust pressure is reduced to, or nearly to, ambient pressure, mufflers and noise reduction systems are not needed. The large openings of the inlet and exhaust valves improve intake and exhaust breathing thereby resulting in improved specific power output.

While the two cylinders necessary for operation suggest a less efficient packaging, the two stroke operation compensates. More particularly, the increased power pulses per revolution coupled with the increased power per stroke offsets any packaging deficiency.

In conventional engines, the combustion chamber shape is dictated in large part by the cylinder size and piston configuration. It will be noted that the combustion chamber is separate in this engine. Such a characteristic allows the engine designer freedom to design a combustion chamber uniquely suited to its function. For example, the combustion chamber configuration can be varied, as desired, to facilitate fuel mixing, exhaust of combustion products, and scouring of the combustion chamber. Moreover, separation of the combustion chamber from the compression cylinder permits the combustion chamber to be insulated to reduce heat losses at top dead center. In a similar vein, the transfer passages, disc valve shoulders, inlet and exhaust ports can all be uniquely designed in accord with their desired functions.

Except for the rotary valve, the engine can utilize conventional engine technology. Moreover, the rotary valve is conducive to high speed operation whereas the inertial forces and stresses imposed in reciprocating poppet valves are not.

Furthermore, since the compression piston and its connecting rod are subjected only to minimal gas loading and relatively low temperatures, light weight design of these parts is both feasible and practical.

It will now be apparent that there has been provided in accordance with the present invention an internal combustion engine which overcomes problems of the type discussed above. Moreover, it will be apparent to those skilled in the art that numerous modifications, variations, substitutions and equivalents exist for features of the invention which do not depart materially from the spirit and scope of the invention. Accordingly, it is expressly intended that all such modifications, variations, substitutions and equivalents which fall within the spirit and scope of the appended claims be embraced thereby.

What is claimed is:

1. An internal combustion engine comprising:

an engine block having a compression cylinder, an expansion cylinder, a combustion chamber, and means providing fluid communication among the combustion chamber, the compression cylinder, and the expansion cylinder;

compression piston means for ingesting and compressing a gas, axially moveable in the compression cylinder;

expansion piston means for expanding and exhausting combustion products, axially moveable in the expansion cylinder;

rotary valve means for regulating gas ingestion, gas transfer to and from the combustion chamber, and gas exhaust, defining at least a partial closure for the compression cylinder and the expansion cylinder, and operable to selectively control the fluid communication means, wherein the rotary valve means includes a rotationally symmetric inlet valve defining an end closure of the compression cylinder, and having an inlet port therein, a first transfer valve including a first valve disc with a first transfer port operably positioned with respect to the fluid communication means to control flow from the compression cylinder to the combustion chamber, a second transfer valve including a second valve disc with a second transfer port operably positioned with respect to the fluid communication means to control flow from the combustion chamber to the expansion cylinder, and a rotationally symmetric exhaust valve defining an end closure of the expansion cylinder, and having an exhaust port therein;

means for supplying fuel to the gas compressed by compression piston means to create a combustible mixture;

means for igniting the combustible mixture; and means for synchronizing movement of the compression piston means, the expansion piston means and the rotary valve means.

2. The internal combustion engine of claim 1 wherein the rotary valve means, the compression piston means and the compression cylinder define a first maximum volume, and wherein the rotary valve means, the expansion piston means and the expansion cylinder define a second maximum volume which is substantially greater than the first maximum volume.

3. The internal combustion engine of claim 2 wherein the ratio of the second maximum volume to the first maximum volume lies in the range of 1.5 to 3.

4. The internal combustion engine of claim 3 wherein the second maximum volume is selected such that gaseous combustion products are expanded to essentially ambient pressure within the expansion cylinder.

5. The internal combustion engine of claim 3 wherein the compression piston means is moveable between two extreme positions which define a stroke and wherein the expansion piston means is moveable between two extreme positions which define a stroke having the same magnitude as the stroke of the compression piston means.

6. The internal combustion engine of claim 1 wherein the compression piston means has a surface which conforms to that portion of the rotary valve means defining at least a partial closure for the compression cylinder.

7. The internal combustion engine of claim 6 wherein the expansion piston means has a surface which conforms to that portion of the rotary valve means defining at least a partial closure for the expansion cylinder.

8. The internal combustion engine of claim 7 wherein the rotary valve means has a rotationally symmetric surface portions which are operable to close one end of the compression cylinder and to close one end of the expansion cylinder.

9. The internal combustion engine of claim 8 wherein each surface portion is circularly cylindrical.

10. The internal combustion engine of claim 6 wherein the compression piston means, the rotary valve means and the compression cylinder define a chamber, and wherein the compression piston means is moveable into a position where essentially all gas in the chamber is essentially forced into the combustion chamber.

11. The internal combustion engine of claim 1 wherein the fuel supply means includes fuel injection means communicating directly with the combustion chamber and operable to supply fuel to a gaseous charge in the combustion chamber.

12. The internal combustion engine of claim 1 wherein:

each of the compression piston means and the expansion piston means is moveable between a top dead center ("TDC") position and a bottom dead center ("BDC") position;

the inlet valve port communicates with the compression cylinder and the first transfer port interrupts flow through the fluid communication means when the compression piston means moves in a direction from the TDC position toward the BDC position;

the inlet valve seals the compression cylinder and the first transfer port permits flow through the fluid communication means when the compression piston means moves in a direction from the BDC position toward the TDC position;

the second transfer port permits flow through the fluid communication means and the exhaust valve seals the expansion cylinder when the expansion piston means moves in a direction from the TDC position toward the BDC position; and the second transfer port interrupts flow through the fluid communication means and the exhaust valve port communicates with the expansion cylinder when the expansion piston means moves in a direction from the BDC position toward the TDC position.

13. The internal combustion engine of claim 12 wherein during at least the first five degrees of movement from TDC toward BDC and the first and second transfer valves interrupt flow through the fluid communication means so that essentially constant pressure ignition of the combustible mixture occurs in the combustion chamber.

14. The internal combustion engine of claim 1 wherein the rotary valve means comprises a single member.

15. The internal combustion engine of claim 1 wherein the engine block includes a pair of compression cylinders separated by a pair of expansion cylinders.

* * * * *